United States Patent [19]

Engel et al.

[11] 4,301,670

[45] Nov. 24, 1981

[54] ROLLING MILL TRAIN

[75] Inventors: Georg Engel, Kaarst; Alfons Spaude, Dusseldorf, both of Fed. Rep. of Germany

[73] Assignee: Schloemann-Siemag Aktiengesellschaft, Dusseldorf, Fed. Rep. of Germany

[21] Appl. No.: 83,265

[22] Filed: Oct. 10, 1979

[30] Foreign Application Priority Data

Oct. 12, 1978 [DE] Fed. Rep. of Germany ..... 2844438

[51] Int. Cl.[3] ..... B21B 1/08

[52] U.S. Cl. ..... 72/226; 72/234

[58] Field of Search ..... 72/199, 229, 234, 366, 72/225, 226, 365

[56] References Cited

U.S. PATENT DOCUMENTS 3,129,617 4/1964 Schulte ..... 72/251

3,342,053 9/1967 Stammbach ..... 72/226

FOREIGN PATENT DOCUMENTS 51-109268 9/1976 Japan ..... 72/366

*Primary Examiner*—Milton S. Mehr

*Attorney, Agent, or Firm*—Holman & Stern

[57] ABSTRACT

Heavy profiled supports or rails may be produced by rolling through a series of rolling stands. Material is passed through a two-high reversing pre-rolling stand, an edging stand, a reversing universal stand, a second compression stand, and a second reversing universal stand. When rails are to be produced the material is passed through stands in through-travel only. When rolling profiled supports it is preferable to replace the stand by a roller train section.

3 Claims, 2 Drawing Figures

ROLLING MILL TRAIN

BACKGROUND OF THE INVENTION

The invention relates to a rolling mill train, in particular one for heavy profiled supports or rails, and comprising one or two two-high reversing pre-rolling stands, two reversing universal rolling stands with always one associated edging stand and preferably a universal finishing rolling stand at the end of the train.

This type of rolling mill train for rolling profiled supports (i.e. beams or griders) or rails is already known (in general terms) from DE-PS No. 1 960 601. In this Specification a reversing universal rolling stand for rolling rails is preceded and/or followed by an edging stand which is displaceable transversely to the rolling line. In order to obtain the number of passes necessary for treating in particular the lateral faces of the rail profile or the head and foot faces either preceding edging stand is provided with grooved rolls which are different over the crown length of the roll set (one of which being displaceable for the first pass and the other being displaceable for a subsequent reversing pass), into the rolling line in the axial direction of the rolls. Also the two different pairs of calibers of the edging stand may be arranged in an edging stand which is arranged in front of or behind the reversing universal rolling stand, wherein likewise the grooved rolls of one of the edging stands are displaced into the rolling line for one reversing pass and the grooved rolls of the other are so displaced for a subsequent reversing pass. A disadvantage of such an arrangement is that for two reversing passes in the reversing universal rolling stand the next grooved rolls following over the length of crown of the reduction rolls must be moved into the rolling line for further reduction of the side flanks of the rail profile. In this case accurate insertion of the respective reduction rolls into the rolling line presents particular difficulties. Moreover the new grooved rolls must be effected into the rolling line within the period of time available prior to the next reduction pass. In this case the continuous material throughput may be disadvantageously affected by time delays, or the rolling process may be disadvantageously affected in respect of maintenance of tolerance limits of the profiled rail, or of operational reliability, respectively, owing to inaccurate alignment of the grooved rolls of the edging stand relative to the rolling line.

SUMMARY OF THE INVENTION

It is an object of the invention to avoid a edging stand which is necessarily displaceable into the rolling line during the rolling operation and to avoid the disadvantages associated with this. These defects can be achieved while obtaining an appropriate grooved roll sequence for the optimum deformation of the highly loaded rail parts, such as head and foot pieces.

In order to achieve this, especially when rolling rails, it is proposed that a further edging stand is arranged in front of or behind the second reversing universal rolling stand, and an additional compression pass is effected through this further stand, rolling being effected merely in travel-through operation in the second reversing universal rolling stand with the associated further edging stand.

The further edging stand is preferably displaceable from the rolling line, for rolling profiled beams especially, and the gap is preferably bridgeable by an insertable roller train section.

It is an advantage of this arrangement that, in consequence of the alignment of the grooved rolls of the further edging stand, an accurate caliber adjustment relative to the rolling can be ensured, even prior to the start of the operation. As a result, maintenance of tolerance limits of the finished cross-sections of the rails or other product can be improved. Furthermore, disturbances of operation can be avoided and the throughput efficiency of the rolling mill train can be increased.

BRIEF DESCRIPTION OF THE DRAWINGS

The invention is further illustrated with reference to the accompanying drawings, in which.

DETAILED DESCRIPTION OF THE INVENTION

Figure 1:
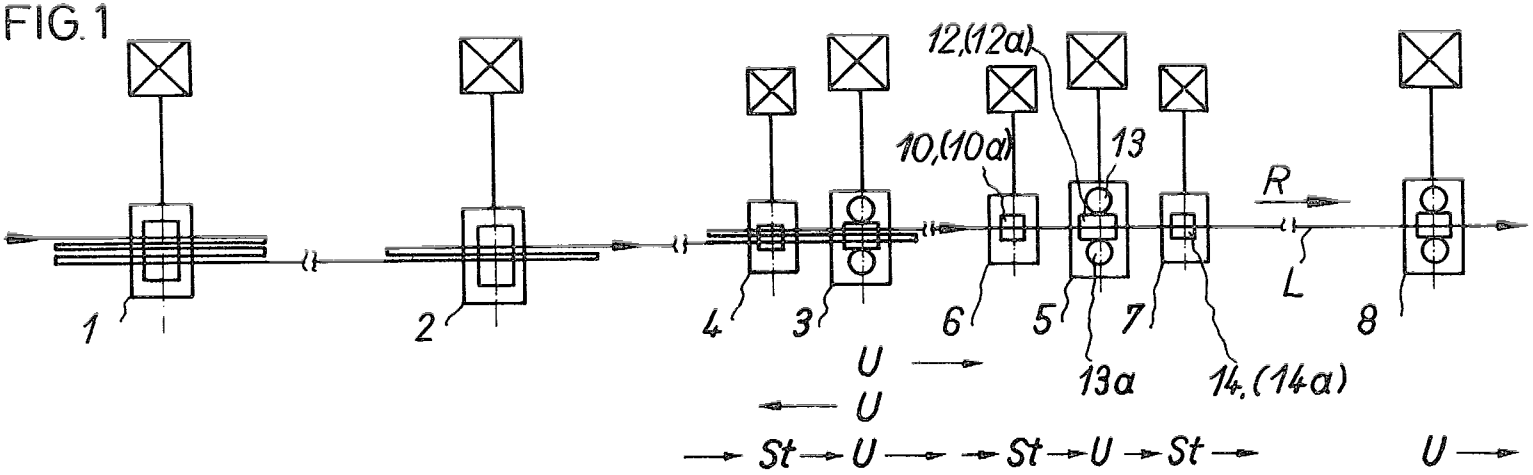
FIG. 1 shows an arrangement, in principle, of rolling stands in a rolling mill train.

FIG. 1 shows diagrammatically a two-high reversing pre-rolling stand 1 in which a slab is pre-rolled in a plurality offorward and backward passes. Further pre-rolling is then effected in a two-high reversing pre-rolling stand 2, likewise in a plurality of forward and backward passes. The rolled material rod W issuing with the pre-forming pass from the two-high reversing pre-rolling stand 2 then travels into a further group of stands comprising a reversing universal rolling stand 3 with preceding edging stand 4. The reversing universal rolling stand 3 possesses horizontal and vertical roll sets with grooved rolls lying in a common rolling plane, whereas the edging stand 4 comprises a set of horizontal rolls with grooved profiles. During the first forward and backward passes rolling is effected in the reversing universal rolling stand 3 with the rolls open, whereas during the following forward pass the edging stand 4 and the reversing universal rolling stand 3 are made to deform the rolled material rod W. Thereafter the rod W travels with free exit into the next group of stands, which consists of one universal reversing rolling stand 5 with preceding and following edging stands 6 and 7. The rod W passes through these in through-travel, i.e. through the horizontal roll sets 10, 10*a* and 14, 14*a* of the edging stands 6 and 7 respectively, as well as the horizontal sets 12, 12*a* and vertical sets 13, 13*a*. These affecting roll sets deform the rolled material rod W in through-travel operation. Thereafter the rolled material rod W travels through a universal finishing rolling stand 8 in which horizontal and vertical roll sets disposed in one rolling plane perform an after-treatment pass for the tolerance-holding finished rolled rail profile. Owing to the additional arrangement of the edging stand 6 in the second stand group between the stand 3 and the universal finishing stand 5, it is possible to obtain at least five passes in the universal rolling stands and three edging passes. This number of passes is generally necessary for the formation of a suitable rail profile. In this case the advantage resides in the fact that the edging stand 6 can be adjusted accurately to the rolling line L prior to the start of the rail rolling, thus avoiding rolling faults and disadvantageous effects in the throughput. The horizontal rolls of the edging stands, in a particular manner, exert a deforming and reinforcing effect upon the head and foot pieces of the profiled rail.

The edging stand 6 can be removed from the rolling line L for the purpose of rolling profiled supports, i.e. beams or girders and the gap produced may be bridged by an insertable roller train section.

Figure 2:
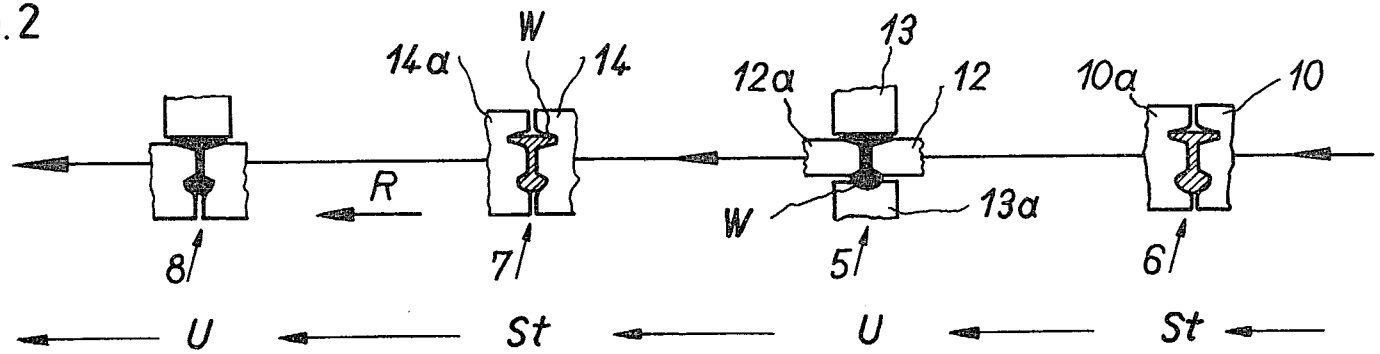
FIG. 2 shows diagrammatically an arrangement of a second reversing universal rolling stand with preceding and following compression stands.

The second group of stands is diagrammatically illustrated in FIG. 2. In this Figure, a rolling line L is illustrated in which the rolled material rod W of the profiled rail is rolled. The horizontal grooved rolls of edging stand 6 are denoted by numerals 10, 10*a*. The reversing universal rolling stand 5 possesses horizontal grooved rolls 12, 12*a* and vertical grooved rolls 13, 13*a* which are disposed in one plane. For the purpose of rolling rails especially, the reversing universal rolling stand 5 is operated in through-travel operation, i.e. only in the rolling direction R. The edging stand 7 is provided with horizontal rolls 14, 14*a*. The rolling stands preferably have individual drives driven via gears.

When profiled supports, i.e. beams or girders are being rolled, operation is effected by means of the second universal rolling stand group 5 with edging stand 7 and, under certain circumstances with edging stand 6 in reversing operation.

We claim:

1. A rolling mill train comprising two two-high reversing rolling stands; an associated edging stand; a reversing universal rolling stand and a further reversable universal rolling stand having a preceding and a following edging stand; and a universal finishing rolling stand, wherein said further reversable universal rolling stand, said preceding and following edging stands and said universal finishing rolling stand are aligned and drivable to roll a rail in a single continuous pass therethrough, and one of said preceding and said following edging stands is movable transversely out of the train for rolling a beam without using said preceding edging stand.

2. A rolling mill train according to claim 1, wherein said one transversely movable edging stand is said preceding edging stand.

3. A rolling mill train according to claim 1, wherein said further reversible universal rolling stand is reversed when a beam is being rolled.

* * * * *